US009248684B2

(12) United States Patent
Wang et al.

(10) Patent No.: US 9,248,684 B2
(45) Date of Patent: Feb. 2, 2016

(54) RECORDING MATERIAL

(75) Inventors: Hongqian Wang, West Lafayette, IN (US); Xiaoqi Zhou, San Diego, CA (US); Gracy Apprisiani Wingkono, San Diego, CA (US); David Edmondson, San Diego, CA (US); Vladek Kasperchik, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,617

(22) PCT Filed: Mar. 30, 2012

(86) PCT No.: PCT/US2012/031400

§ 371 (c)(1),
(2), (4) Date: Jul. 25, 2014

(87) PCT Pub. No.: WO2013/147836

PCT Pub. Date: Oct. 3, 2013

(65) Prior Publication Data

US 2015/0072089 A1 Mar. 12, 2015

(51) Int. Cl.

| | |
|---|---|
| ***B41M 5/40*** | (2006.01) |
| ***B41M 5/52*** | (2006.01) |
| ***B41M 5/50*** | (2006.01) |

(Continued)

(52) U.S. Cl.

CPC ..... *B41M 5/5218* (2013.01); *B41M 5/0023* (2013.01); *B41M 5/506* (2013.01); *B41M 5/508* (2013.01); *B41M 5/52* (2013.01); *D21H 23/22* (2013.01); *D21H 25/14* (2013.01); *B41M 5/5254* (2013.01); *B41M 2205/38* (2013.01)

(58) Field of Classification Search

CPC .... B41M 5/5218; B41M 5/508; B41M 5/506; B41M 5/0023; B41M 2205/38; D21H 23/22; D21H 25/14

USPC ..... 428/32.24, 32.25, 32.32; 427/243; 347/105

See application file for complete search history.

(56) References Cited

U.S. PATENT DOCUMENTS

| | | | | |
|---|---|---|---|---|
| 6,432,550 | B1 * | 8/2002 | Ohbayashi et al. | 428/511 |
| 6,695,447 | B1 * | 2/2004 | Wexler | 347/105 |

(Continued)

FOREIGN PATENT DOCUMENTS

| | | |
|---|---|---|
| CN | 101415563 | 4/2009 |
| EP | 0500021 | 8/1992 |

(Continued)

OTHER PUBLICATIONS

International Search Report dated Nov. 16, 2012 for International application No. PCT/US2012/031400 filed Mar. 30, 2012, Applicant Hewlett-Packard Development Company, L.P. et al.

(Continued)

*Primary Examiner* — Betelhem Shewareged

(74) *Attorney, Agent, or Firm* — Thorpe, North & Western L.L.P.

(57) ABSTRACT

A printable recording material containing an opaque supporting substrate; a resin barrier layer; an ink vehicle-receiving layer having a first structure with inorganic particles and, at least, a binder and a second structure with nano-porous particles and, at least, a binder; and an ink colorant-receiving layer. Also disclosed are the method for making such material and the method for producing printed images using said printable recording material.

14 Claims, 2 Drawing Sheets

(51) Int. Cl.

| | |
|---|---|
| ***B41M 5/00*** | (2006.01) |
| ***D21H 23/22*** | (2006.01) |
| ***D21H 25/14*** | (2006.01) |

(56) References Cited

U.S. PATENT DOCUMENTS

| | | | | |
|---|---|---|---|---|
| 6,808,947 | B2 * | 10/2004 | Farnworth et al. | 438/16 |
| 6,936,316 | B2 | 8/2005 | Nigam et al. | |
| 7,641,947 | B2 * | 1/2010 | Chen et al. | 428/32.22 |
| 7,866,811 | B2 | 1/2011 | Sen et al. | |
| 7,897,203 | B2 | 3/2011 | Oriakhi et al. | |
| 7,955,668 | B2 * | 6/2011 | Fu et al. | 428/32.22 |
| 2001/0016249 | A1 | 8/2001 | Kitamura et al. | |
| 2007/0134450 | A1 * | 6/2007 | Campbell et al. | 428/32.34 |
| 2009/0202753 | A1 | 8/2009 | Teramae et al. | |
| 2009/0220695 | A1 | 9/2009 | Oyanagi et al. | |
| 2011/0212278 | A1 | 9/2011 | Watanabe et al. | |
| 2013/0183501 | A1 * | 7/2013 | Kasperchik et al. | 428/207 |

FOREIGN PATENT DOCUMENTS

| | | |
|---|---|---|
| EP | 1321301 | 6/2003 |
| EP | 1340621 | 9/2003 |
| JP | 2000281966 | 10/2000 |
| JP | 2001010215 | 1/2001 |
| KR | 1020070106706 | 11/2007 |

OTHER PUBLICATIONS

Extended European Search Report dated Dec. 4, 2014, Application No./U.S. Pat. No. 12873426.6-1704 PCT/US2012/031400, Applicant Hewlett-Packard Development Company, L.P., Reference No. 83986403.

* cited by examiner

RECORDING MATERIAL

BACKGROUND

Inkjet technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of media substrates. These printable media or recording material can be cut sized sheets or commercial large format media such as banners and wallpapers. Current inkjet printing technology involves forcing the ink drops through small nozzles by thermal ejection, piezoelectric pressure or oscillation, onto the surface of such media. Within said printing method, the media substrate plays a key role in the overall image quality and permanence of the printed images.

Nowadays, prints and printed articles with specific characteristics and appearances, such as, for examples, metallic appearances and/or reflectivity, are often desired. Accordingly, investigations continue into developing media and/or printing methods that can be effectively used with such printing techniques, which impart good image quality and which allow the production of specific appearances.

BRIEF DESCRIPTION OF THE DRAWING

The accompanying drawings illustrate various embodiments of the principles described herein and are a part of the specification. The illustrated embodiments are merely examples and do not limit the scope of the claims.

DETAILED DESCRIPTION

Figure 1:
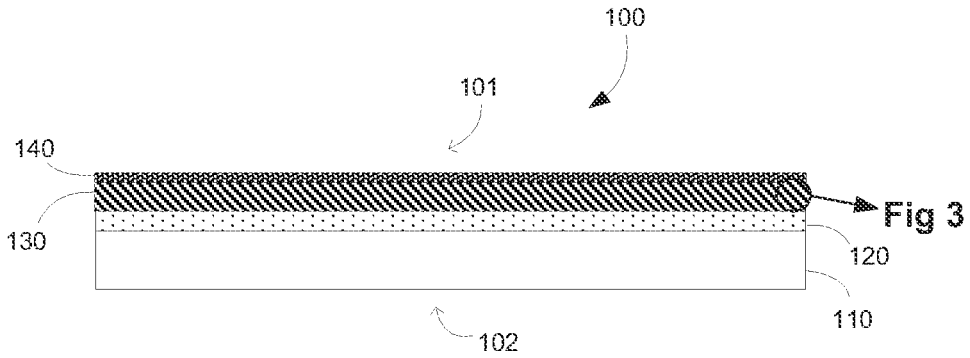
FIGS. 1 and 2 are cross-sectional views of the printable recording material according to embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Thus, for example, reference to "a particle" includes reference to one or more of such materials. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated. As another example, a range of 1 part to 20 parts should be interpreted to include not only the explicitly recited concentration limits of about 1 part to about 20 parts, but also to include individual concentrations such as 2 parts, 3 parts, 4 parts, etc. All parts are dry parts in unit weight, with the sum of the inorganic pigment equal to 100 parts, unless otherwise indicated.

The disclosure describes a printable recording material containing an opaque supporting substrate; a resin-rich barrier layer; an ink vehicle-receiving layer having a first structure with porous inorganic particles and, at least, a binder and a second structure with nano-porous particles and, at least, a binder; and an ink colorant-receiving layer containing inorganic particles. Also described herein is a method for making such printable recording material. The present disclosure also refers to a method for producing printed images on said printable recording material. The present disclosure also refers to the resulting printed article. Said printing method enables indeed the production of printed articles with a metallic appearance. Said method enables thus the creation of text and graphic prints with metallic color appearance on the printable recording material as described herein.

In some examples, the printable recording material is a printable recording medium that is able to exhibit metallic appearance when used in a printing method. In some other examples, such printable recording material is an inkjet recording material well adapted for inkjet printing device. Said material has a multilayered structure that encompasses a bottom supporting substrate and coating layers. Such combination of layers and supporting substrate form a printable recording medium having improved printing performances and that is able to generate the images having reflective metallic appearance.

The term "ink receiving layer" refers to layer, or multiple coating layers, that are applied to a supporting substrate and which are configured to receive ink upon printing. As such, the ink receiving layers do not necessarily have to be the outermost layer, but can be a layer that is beneath other coating. Ink receiving layers might be in the form of a porous media coating or on the form of other types of media coatings such as aqueous or organic solvent swellable coatings. In some examples, the printable recording medium of the present disclosure is a porous substrate that can be used in inkjet printing and that is able to generate the images that combine high metallic reflectivity with an enhanced print image quality. In addition, such printable recording medium has high liquid absorbing capacity. Such fast ink absorption results therefore in good print resolution, quality and edge definition.

The metallic appearance can be defined as the human perception of metal luster generated from a smooth metal surface (such as gold, copper, aluminum and chromium). In the principle described herein, the metallic appearance refers to the reflected light wave that is perceived by observer from a strong specular (directional) light reflection off the object surface. A surface appears having a metallic luster, from human perception, if it is able to reflect at specular angle greater than 10 to 20% of the incident light intensity (Highly polished smooth surface of metals elements such as gold, copper, aluminum and chromium can reflect up to 85 to 95% of incident visible light). The higher the intensity of the reflected light at specular angle is (combined with low reflection off specular angle), the stronger metallic appearance is.

The Printable Recording Media

Figure 2:
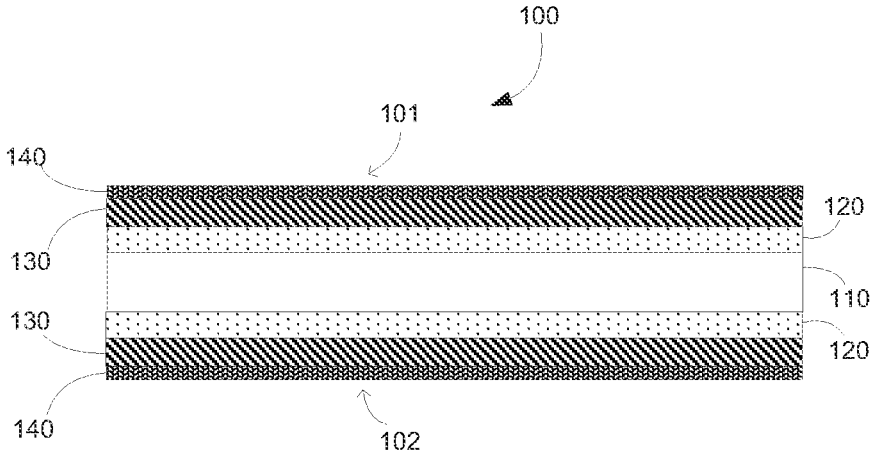

FIG. 1 and FIG. 2 illustrate embodiments the printable recording material (100) as described herein. As will be appreciated by those skilled in the art, the figures illustrate the relative positioning of the various layers of the recording media (100) without necessarily illustrating the relative thicknesses of said layers.

FIG. 1 illustrates some embodiments of the recording media (100). Such media includes a resin-rich barrier layer (120) that is applied on the image side (101) of the base substrate (110). The recording media (100) encompasses, also, an ink vehicle-receiving layer (130) that is applied over the resin-rich barrier layer (120) and an ink colorant-receiving layer (140) that is deposited at the surface of said ink vehicle-receiving layer (130). The supporting substrate (110) has two surfaces: a first surface that might be referred to as the "image surface" or "image side" (101), and a second surface, the opposite surface, which might be referred to as the "back surface" or "back side" (102). FIG. 1 illustrates some embodiments of the recording material (100) wherein such material includes a resin-rich barrier layer (120), an ink vehicle-receiving layer (130), and an ink colorant-receiving layer (140) applied only on the image side (101) of the supporting substrate (110).

FIG. 2 illustrates some other embodiments of the recording material (100) wherein such material includes resin barrier layers (120), ink vehicle-receiving layers (130) and ink colorant-receiving layers (140) that are deposited on both sides of the supporting substrate (110). Said layers are thus present on the backside (102) and on the image side (101) of the base substrate (110). FIG. 2 illustrates thus a double-side recording material (100) that has a sandwich structure, i.e. both sides of the supporting substrate (110) are coated with the same coating and both sides may be printed.

Figure 3:
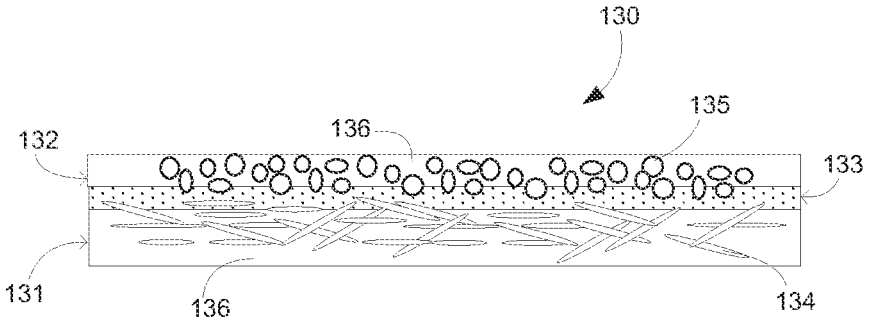
FIG. 3 is a detailed cross-sectional view of the ink vehicle-receiving layer according to one example of the principles described herein.

FIG. 3 illustrates details of the ink vehicle-receiving layers (130). Said ink vehicle-receiving layer (130) contains a first structure (131) that encompasses inorganic particles (134) and, at least, a binder (136) and a second structure (132) that encompasses nano-porous particles (135) and at least a binder (136).

Figure 4:
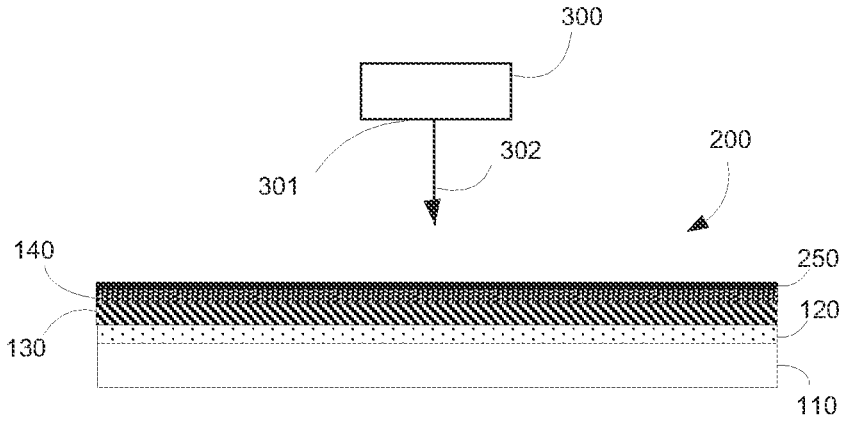
FIG. 4 is a detailed cross-sectional view illustrating methods for producing printed articles according to some embodiments of the present disclosure.

FIG. 4 illustrates an example of printing method for forming a printed article according to the present disclosure. In such method, the printer (300) has, at least, one orifice (301) that dispenses droplets of ink composition along a trajectory (302), to the surface of the printable recording media (100), on the ink colorant-receiving layer (140), in view of forming a printed article (200) that encompasses a printed feature (250). In some examples, said printed feature (250) contains metal oxide particles that are retained at the surface of the ink colorant-receiving layer (140) and that form a metal oxide coating layer. The average pore size of the ink colorant-receiving layer (140) is small enough to retain practically all metal oxide particles on the surface while, in the same time, absorbing the liquid phase of the ink composition into the media.

The Supporting Substrate

In some embodiments, the recording material (100) encompasses an opaque supporting substrate (110). The supporting substrate is a base layer that provides mechanical strength and stiffness to the recording material and provides surfaces on which coatings can be formed. The terms "opaque", as used herein, refers to a material that is not transparent (but may have a uniform color, multiple colors, or particles of color) and images cannot be seen through it at all, or only slightly and not clearly. The degree of opacity could be defined as the measurement of impenetrability to electromagnetic or any other kinds of radiation, especially visible light. In some examples, the opacity of the supporting substrate (110) is greater than 80%, or, greater than 85%, when measured with the TAPPI Method T 425 om-11.

The coatings, in accordance with the principles described herein, can be applied to one side or to both opposing sides of the supporting substrate. If the coated side is used as an image-receiving side, the other side, i.e. backside, may not have any coating at all, or may be coated with other chemicals (e.g. sizing agents) or coatings to meet certain needs such as to balance the curl of the final product or to improve sheet feeding in printer. The supporting substrate (110), on which coating compositions are applied, may take the form of a media sheet or a continuous web suitable for use in an inkjet printer. The supporting substrate may be a base paper manufactured from cellulose fibers. The base paper may be produced from chemical pulp, mechanical pulp or from pulps resulting from hybrid processes, such as thermo-mechanical pulp (TMP) and chemio-thermomechanical pulps (CTMP). The cellulose fibers can be made from hardwood or softwood species where hardwood fibers may have an average fiber length between about 0.5 to about 3 mm and where softwood fibers may have an average length between about 3 and about 7 mm. The ratio of hardwood to softwood fibers can range from 100:0 down to 50:50. In some examples, the hardwood to softwood fiber ratio is of about 80:20 by weight. The supporting substrate can include both cellulose fibers and synthetic fibers. The use of synthetic fiber might improve dimension stability and reduce moisture absorption when excessive aqueous ink vehicle is jetted on the receiving materials. The synthetic fibers can be made by polymerization of organic monomers. The synthetic fibers include fibers formed from polyolefins, polyamides, polyesters, polyurethanes, polycarbonates and polyacrylics. Other examples of the synthetic organic fibers made from polyolefins or polyolefin copolymers include polyethylene fibers, polyethylene copolymer fibers, polypropylene fibers, polyethylene copolymer fibers, or polypropylene copolymer fibers. Polyethylene or polypropylene copolymers may refer to the copolymers of ethylene and/or propylene with linear alkenes such as 1-butene, 1-hexene, 1-octene, 1-decene, 1-dodecene, 1-tetradecene, 1-hexadecene and 1-octadecene. Polyethylene or polypropylene copolymers can also refer to the copolymers of ethylene and/or propylene with branched alkenes, such as isobutene. Ethylene copolymer can be ethylene with vinyl acetate and with partial or complete hydrolysis products, such as polyvinyl alcohol fibers. In some examples, the content of the synthetic fiber is from about 3 to about 50 wt % of the total fiber weight or could be in the range of about 5 to about 20 wt % of total fiber weight.

In some examples, the supporting substrate includes additives such as internal sizing agents and fillers. Without being linked by any theory, the internal sizing agent may provide hydrophobicity to the base and fillers may contribute to a higher opacity. The paper base can contain fillers in an amount representing from about 5% to about 50% by total weight of the raw base. As a non-limiting example, the fillers may be selected from calcium carbonate, talc, clay, kaolin, titanium dioxide and combinations thereof. In some examples, the supporting substrate includes $TiO_2$ particles as inorganic fillers to improve opacity.

In some examples, the supporting substrate includes inorganic fillers in an amount representing from about 8 wt % to about wt 40% by total weight of the supporting substrate. In some other examples, the supporting substrate includes inorganic fillers in an amount ranging from about 10 wt % to about wt 30%. In yet some other examples, the inorganic fillers is a mixture of calcium carbonate and $TiO_2$ particles and is present in an amount representing more than about 15 wt % by total weight of the supporting substrate. Said mixture of calcium carbonate and $TiO_2$ particles has a weight percentage of about 5 wt % to about 30 wt % of fillers per total weight of the mixture.

The supporting substrate (110) can have a base weight ranging from about 90 to about 300 grams/meter$^2$ (gsm), or can have a base weight ranging from about 100 to about 220 gsm.

The Resin-Rich Barrier Layer

The printable recording material (100) encompasses a resin-rich barrier layer (120) that is applied on top of the supporting substrate (110). Said barrier layer (120) is deposited on, at least, one side of the base substrate (110) or is deposited on both side of the base substrate (110). Without being linked by any theory, it is believed that said layer helps to avoid absorption of aqueous solvents into the media substrate. Indeed, inkjet ink contains large amount of aqueous solvents, mostly water. When such ink is applied on the receiving media, the aqueous solvent can be absorbed into the substrate and cause cellulose fiber swelling. This effect may cause adversely paper cockling and destroy paper smoothness which in turn reduce light reflectance.

The barrier layer can be considered as resin-rich pigmented coating layer that reduce the penetration of exterior moisture into the substrate. The barrier layer can include one or more types of pigment particles and polymer resin binders. The resin-rich barrier layer may include polymer resin binder in amounts that represent, at least, 10 wt % of the total pigment fillers. In some example, the barrier layer includes from about 30 to about 80 wt % of polymer resin binder by total weight of barrier layer (120). In some other example, the barrier layer includes 40 to 70 wt % of resins by total weight of barrier layer. The polymer resins act, both, to hold pigments together and as a moisture barrier that prevents moisture absorption from environment. A wide variety of resin binder compositions can be used in the barrier layer. Such resin binder compositions may include, but are not limited to, resins formed by polymerization of hydrophobic addition monomers. Examples of hydrophobic addition monomers include, but are not limited to, $C_1$-$C_{12}$ alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), and aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomer, $C_1$-$C_{12}$ alkyl acrylamide and methacrylamide (e.g., t-butyl acrylamide, sec-butyl acrylamide, N,N-dimethylacrylamide), crosslinking monomers (e.g., divinyl benzene, ethyleneglycol dimethacrylate, bis(acryloylamido)methylene), and combinations thereof. In some examples, the glass transition temperature of the polymer resin ranges from about 20° to about 80° C. In some embodiments, the resins are formed by hydrophobic polymerization of monomers of $C_3$-$C_{12}$ alkyl acrylate and methacrylate.

The polymers can be made using a wide variety of polymerization methods such as bulk polymerization, solution polymerization, emulsion polymerization, or other suitable methods. In some examples, the resins are made from emulsion polymerization using the monomers described above and can be in the form of emulsion or latex. The emulsion polymerization in the presence of aqueous solvent such as water may be useful in making the polymer resins described above. Polymer resin binders can be made using emulsion polymerization with a particle size ranging from 0.1 to 5 micrometers or ranging from 0.5 to 3 micrometers.

The resin can be polymers of olefin monomers and comonomers (alkene with the general formula $C_nH_{2n}$). The polymerization process can be radical polymerization, anionic addition polymerization, ion coordination polymerization or cationic addition polymerization, for example, coordination polymerization via Phillips and Ziegler-type catalysts and metallocenes type of catalysts.

Inorganic pigments can also be present in resin-rich barrier layer (120). The inorganic pigments can have a mean size ranging from about 0.2 micrometers to about 1.5 micrometers (μm). These inorganic pigments can be in a powder or slurry form. Examples include, but are not limited to, titanium dioxide, hydrated alumina, calcium carbonate, barium sulfate, silica, clays (such as high brightness kaolin clays), and zinc oxide. The resin-rich barrier layer can contain calcium carbonate.

In some examples, the resin-rich barrier layers (120) can be deposited on both sides of the base substrate (110). The coat weight of the resin-rich barrier layer can range from about 0.01 to about 20 grams/meter$^2$ (gsm). In some other examples, the coat weight of the resin-rich barrier layer is from about 0.2 to about 5 grams/meter$^2$ (gsm). The resin-rich barrier layer can be applied onto the substrate by paper methods such as rod coating, blade coating, film transfer coating, air knife coating, slot die coating and/or curtain coating. The resin-rich barrier layer can also be applied onto the substrate by a heated extrusion method with a coat weight ranging from about 0.5 to about 20 gsm.

The Ink Vehicle-Receiving Layer

The printable recording material (100) of the present disclosure encompasses an ink vehicle-receiving layer (130). Without being linked by any theory, it is believed that said layer has a porous receiving surface and a porous bulk structure that can absorb ink vehicle quickly so that ink bleeding or coalescence can be minimized. In addition, such ink vehicle-receiving layer (130) provides a smooth media surface that enhances incident light reflection and therefore, enhances metallic appearance when metallic ink is applied to the recording medium.

Such as illustrated in FIG. 3, the ink vehicle-receiving layer (130) encompasses a first structure (131) containing porous inorganic particles (134) and, at least, a binder (136) and a second structure (132) containing nano-porous particles (135) and, at least, a binder (136).

In some examples, the porous ink vehicle-receiving layer (130) encompasses a fused interface (133) located between the first structure (131) and the second structure (132). Such fused interface (133) can be defined as the range along z-direction where inorganic particles of the first structure (131) and of the second structure (132) co-exist. The thickness of interface (133) can be between about 1 and about 5 micrometer (μm). If the thickness is too small i.e., if there is a distinctive broader line between structures, the metallic appearance is reduced due to decrease of absorption speed. To create such fused interface structure, a wet-to-wet coating method could be applied. In some examples, particles of the second structure are applied on the top of the first structure when it is still in the low viscosity status without drying. It is thus believed that particles of the second structure are able to migrate into top surface of the first structure. In view of achieving these particles movement, the solution density, viscosity and surface tension of the two particles composition are adjusted. The density ratio of the second structure composition to that of the first structure composition can be in the range of from 0.6 to 0.85, or from 0.7 to 0.8. The viscosity of the first structure composition can be from 1.3 to 1.7 times lower than that of the second structure composition. For the large scale manufacture, such fused interface can be made by special coaters that are capable to produce multi-layer structure coating such as slot-die coater or curtain coater.

The first structure (131) has a large pore size, which improves surface smoothness of the substrate while provide ink absorption capacity for ink vehicle. The first structure (131) contains inorganic particles and at least a binder, which provide adhesion force between particles and barrier layer, and adhesion force among particles. The particles can have a micro-porous structure and/or are able to form a porous structure during coating solidification by giving a "packing" structure with voids. In some examples, the first structure (131) has an average pore size in the range of about 70 nm to about 250 nm. In some other examples, the first structure (131) has an average pore size in the range of about 80 nm to about 200 nm. In yet some other examples, the first structure (131) has an average pore size in the range of about 100 nm to about 170 nm. The thickness of the first structure (131) ranges from about 3 to about 25 micrometers (μm). The first structure (131) can be applied over the resin-rich barrier layer (120) with a coating weight ranging from about 5 to about 30 grams/meter$^2$ (gsm), or with a coat weight ranging from about 10 to about 20 gsm.

The first structure (131) includes inorganic pigments. The inorganic pigments can have an average particle size of less than about 5 μm. In some examples, the inorganic pigments have an average particle size ranging from about 0.1 to about 1 μm or have an average particle size that is less than about 0.4 μm.

Examples of inorganic pigments are, but not limit to, titanium dioxide, hydrated alumina, calcium carbonate, barium sulfate, silica, zinc oxide, zeolite, alumina, boehmite, silicates (such as aluminum silicate, magnesium silicate and the like), aluminum trihydrate (ATH), titania, zirconia, clay, calcium silicate, kaolin clay, calcined clay or combinations thereof. The physical form of the pigments can be either powder or aqueous pre-dispersed slurry. Other inorganic particles such as particles of titanium dioxide (TiO2), silicon dioxide (SiO2), aluminum trihydroxide (ATH), calcium carbonate (CaCO3) and zirconium oxide (ZrO2) can be intercalcined into the structured clay or calcium carbonates. In some examples, the inorganic pigments of the first structure are calcium carbonates or clays.

Calcium carbonate can be precipitated calcium carbonate (PCC), ground calcium carbonate (GCC pigment) or modified calcium carbonate (MCC). The clay particles can be kaolin clay, hydrated clay, calcined clay, or other material capable of functioning in a similar manner. Ground calcium carbonate (GCC), modified calcium carbonate (MCC), precipitated calcium carbonate (PCC) and clay particles may be prepared in accordance with methods that are described in the literature, for example, in Chapter 2, in "The Coating Processes" edited by J. C. Walter, Tappi Press, Atlanta, Ga., 1993. Suitable preparations of PCC are commercially available from Specialty Minerals Inc under the name Opacarb®A40 (aragonite crystalline structure). MCC (modified calcium carbonate) are commercially available from Omya under the tradename Omyajet®5020. The pigment particles can also be ultrafine kaolin clay, such as Miraglos®91, manufactured by Engelhard Corporation (Iselin, N.J., U.S.A.), or Polygloss®90, manufactured by J.M. Huber Corporation (Edison, N.J., U.S.A.). Calcined clay is commercially available, such as Ansilex®93, manufactured by Engelhard Corporation (Iselin, N.J., U.S.A.), or Neogen®2000, manufactured by Imerys Pigments, Inc. (Roswell, Ga., U.S.A.).

In some examples, at least a binder is used in the coating formulation of the first structure (131) of the ink vehicle-receiving layer (130). The binders can be water soluble binders, water dispersible polymers or polymeric emulsions that exhibit high binding power for base paper stock and pigments, alone or as a combination. The amount of binder in the first structure (131) of the ink vehicle-receiving layer (130) may be in the range of about 5 to about 15 parts, or in the range of about 8 to about 10 parts, based on 100 parts of inorganic pigments. Such binders can be homopolymer and/or copolymer of polyvinylalcohol polyvinylpyrrolidone and polyacrylate. The copolymers can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate or methyl vinylketone. The polymers and copolymers can have a weight average molecular weight ranging from about 10,000 Mw to about 1,000,000 Mw or can have a weight average molecular weight ranging from about 20,000 Mw to about 500,000 Mw. In some examples, the binder is a polyvinylalcohol having a molecular weight in the range of about 20,000 to about 500,000.

In some examples, the second structure (132) of the ink vehicle-receiving layer (130) has an average pore size that is smaller than the average pore size of first structure (131). The second structure (132) can have an average pore size that is about 5 to 15 times smaller than the average pore size of first structure (131). In some other examples, the second structure (132) has an average pore size in the range of about 10 nm to about 100 nm, or in the range of about 20 nm to about 70 nm. In some embodiments, the second structure (132) of the ink vehicle-receiving layer (130) has an average pore size that is smaller than the average pore size of first structure (131) and that is in the range of about 10 nm to about 100 nm.

Such pore size generates strong capillary effect to absorb the ink vehicle effectively into the first structure through the channel created in the second structure. In some examples, the printable recording material has an ink vehicle-receiving layer (130) that encompasses a first structure (131) with an average pore size in the range of about 70 nm to about 250 nm and a second structure (132) with an average pore size in the range of about 10 nm to about 100 nm.

The thickness of the second structure (132) ranges from about 0.3 to about 15 μm, or ranges from about 2 to about 10 μm. The second structure (132) can be applied over the first structure (131) with a coating weight of about 0.4 to about 15 grams/meter$^2$ (gsm), or with a coat weight ranging from about 1 to about 10 gsm. In some embodiments, the ink vehicle-receiving layer (130) encompasses a first structure (131) that is applied over the resin-rich barrier layer (120) with a coating weight of about 5 to about 30 gsm, and a second structure (132) that is applied over the first structure (131) with a coating weight of about 0.3 to about 15 gsm.

The second structure contains nano-porous particles and, at least, a binder that provide adhesion force between particles and barrier layer and among particles. The "nano-porous particles" are primary particles or aggregated "macroparticles", both in the nano-meter range. The primary particles are not necessarily porous but are able to form porous aggregated particles. Examples of nano-porous particles are fumed silica, fumed alumina, boehmite and pseudo-boehmite.

The inorganic pigment particles can be fumed silica (modified or unmodified). Commercially available fumed silica encompasses Cab-O-Sil®LM-150, Cab-O-Sil®M-5, Cab-O-Sil®MS-55, Cab-O-Sil®MS-75D, Cab-O-Sil®H-5, Cab-O-Sil®HS-5, Cab-O-Sil®EH-5, Aerosil®150, Aerosil®200, Aerosil®300, Aerosil®350 and/or Aerosil®400. In some examples, the aggregate size of the fumed silica particles can be from about 50 to 300 nm in size. In some other examples, the fumed silica particles can be from about 100 to 250 nm in size. The Brunauer-Emmett-Teller (BET) surface area of the fumed silica particles can be from about 100 to 400 meter gram or from about 150 to 300 meter/gram.

The inorganic pigment particles can be modified or unmodified alumina. In some examples, the alumina coating can contain pseudo-boehmite, which is aluminum oxide/hydroxide ($Al_2O_3n$-$H_2O$, where n is from 1 to 1.5). Commercially available alumina particles can also be used, including, but not limited to, Sasol Disperal®HP10, Disperal®HP14, boehmite, Cabot Cab-O-Sperse®PG003 and/or CabotSpectrAl®81 fumed alumina. In some example, the second structure (132) contains fumed silica or fumed aluminas that are aggregates of primary particles. In some other example, second structure (132) contains fumed silica or fumed alumina that are aggregates of primary particles that have an average particle size ranging from about 120 nm to about 250 nm.

In some examples, the second structure (132) encompasses binders that are independently chosen among binders as those defined for the first structure (131) of the ink vehicle-receiving layer (130). The amount of binder that can be added provides a balance between binding strength and maintaining particulate surface voids and inter-particle spaces for allowing ink to be absorbed. The binders may be selected from polymeric binders. In some examples, the binders are water-soluble polymers and/or polymer latexes. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinylamine; cationic polyvinyl alcohols; aceto-acetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval®235, Mowiol®56-88, Mowiol®40-88 (products of Kuraray and Clariant).

Both the first structure (131) and second structure (132) may further include other additives such as mordants, biocides, surfactants, plasticizers, rheology modifiers, defoamers, optical brighteners, pH controlling agents, or other additives for further enhancing the properties of the coating. Among these additives, rheology modifier is useful for addressing runnability issues. Suitable rheology modifiers include polycarboxylate-based compounds, polycarboxylated-based alkaline swellable emulsions, or their derivatives. The rheology modifier is helpful for building up the viscosity at certain pH, either at low shear or under high shear, or both. A rheology modifier can be added to maintain a relatively low viscosity under low shear, and to help build up the viscosity under high shear. It is desirable to provide a coating formulation that is not so viscous during the mixing, pumping and storage stages, but possesses an appropriate viscosity under high shear. Some examples of rheology modifiers include, but are not limited to, Sterocoll® FS (from BASF), Cartocoat® RM 12 (from Clariant), Acrysol® TT-615 (from Rohm and Haas) and Acumer® 9300 (from Rohm and Haas). The amount of rheology modifier in the coating composition may be in the range of about 0.1 to about 2 parts, or in the range of about 0.1 to about 0.5 parts based on 100 parts of inorganic pigments. The coating layer can include surfactants. There is no specific limitation on the chemical structure of surfactant. In some examples, polyalkylene oxide based surfactant such as Surfynol® (supplied by Air Product), or the silicone base surfactants (BYK® surfactants supplied by BYK Inc) can be used.

The Ink Colorant-Receiving Layer

An ink colorant-receiving layer (140) is applied on top of the ink vehicle-receiving layer (130); said ink colorant-receiving layer encompasses inorganic particles. Without being bounded by any theory, it is believed that the ink colorant-receiving layer (140) plays dual functions. One function is to form a physical barrier layer which constraints most of metallic ink colorant particles at the outmost surface, while its specific packed pore size can provide capillary force and flow path to allow the ink vehicle penetrating into the ink vehicle-receiving layer (130). The "packed pore size" refers to the average pore size as measured by Mercury Porosimeter on the coated surface after it is solidified.

The average pore size of the ink colorant-receiving layer (140) is smaller than the average pore size of second structure (132) of the ink vehicle-receiving layer (130) in view of retaining the metal oxide particles of the ink on media surface. In some examples, the ink colorant-receiving layer (140) has an average pore size that is less than 50 nm; in some other examples, that is less than 30 nm. The thickness of the ink colorant-receiving layer (140) can be in the range of about 100 nm and about 600 nm.

In some examples, the ink colorant-receiving layer (140) encompasses inorganic particles having refractive index (n) of superior or equal to 1.65. In some other examples, the refractive index (n) of the inorganic particles is in the range of about 1.7 to about 2.5. In yet some other example, the refractive index (n) of the inorganic particles is in the range of about 1.2 to about 1.8. The refractive index, or index of refraction, of the inorganic particles is a measure of the speed of light in metal oxide particles. It is expressed as a ratio of the speed of light in vacuum relative to that in the particles medium.

The inorganic particles can be metal oxides or complex metal oxides particles. As used herein, the term "metal oxide particles" encompasses metal oxide particles or the insoluble metal salt particles. The metal oxide particles are particles of metal oxide that have high refractive index (i.e. more than 1.65) and that have particle size in the nano-range such that they are substantially transparent to the naked eye. In some examples, the metal oxide and insoluble metal salt are either colorless or have rather weak coloration in thin layers. Without being bound by any theory, it is believed that the metal oxide particles, in themselves, do not exhibit optical variable properties for producing color-shifting effect. In some examples, the average size of the oxide particles is smaller than ¼wavelengths ('/4 JO of the visible wavelength. The visible wavelength is ranging from about 400 to about 700 nm. Therefore, the average size of the metal oxide particles is between about 3 and about 180 nm or may also be between about 5 and about 150 nm. In some examples, the average size of the metal oxide particles is between about 10 and about 100.

Non limiting examples of inorganic particles, that are part of the ink colorant-receiving layer (140), are white or colorless materials such as aluminum oxide, aluminum phosphate, nanocrystalline boehmite alumina (AlO(OH)), beryllium oxide, dysprosium oxide hafnium(IV) oxide, lutetium oxide, scandium oxide, tantalum pentoxide, tellurium dioxide, titanium dioxide, zinc oxide, zirconium dioxide, barium titanate calcium molybdate, calcium tungstate, gallium arsenide oxide, gallium antimonide, oxide potassium niobate, potassium tantalate, potassium titanyl phosphate, lithium iodate, lithium niobate, silicon dioxide, strontium titanate, yttrium aluminium garnet or yttrium vanadate.

In some examples, the ink colorant-receiving layer (140) contains inorganic particles that can be selected from the group consisting of aluminum oxide ($Al_2O_3$), silicon dioxide ($SiO_2$), nanocrystalline boehmite alumina (AlO(OH)) and aluminum phosphate ($AlPO_4$). In some other examples, the ink colorant-receiving layer (140) contains aluminum oxide ($Al_2O_3$) or silicon dioxide ($SiO_2$). In yet some other examples, the ink colorant-receiving layer (140) contains aluminum oxide ($Al_2O_3$).

The ink colorant-receiving layer (140) may also contain a binder that can independently selected from the binders present in the first structure or in the second structure of the ink vehicle-receiving layer (130).

The ink colorant-receiving layer (140) can be formed with variety of suitable coating methods, such as: blade coating, air knife coating, metering rod coating, film transfer coating, slot die coating, curtain coating, pressure jetting coating, thermal jetting coating, spray coating or another suitable technique. It can be also formed by other deposition techniques such as plasma deposition, sputtering deposition, and electron beam deposition. In some embodiments, the ink colorant-receiving layer (140) is applied over the ink vehicle-receiving layer (130) with a coating weight of about 0.01 to about 5 gsm, or with a coating weight of about 0.1 to about 2 gsm.

Method for Making the Printable Media

A method of making the printable recording media (100), such as defined above, includes providing an opaque supporting substrate; applying a resin-rich barrier layer (120) onto said opaque supporting substrate (110); applying an ink vehicle-receiving layer (130) and depositing an ink colorant-receiving layer (140), containing inorganic particles, on top of said layers; and drying and calendaring the layers. The ink vehicle-receiving layer (130) encompasses a first structure with inorganic particles and at least a binder, and a second structure with nano-porous particles and at least a binder. The resin-rich barrier layer (120), the ink vehicle-receiving layer (130) and the ink colorant-receiving layer (140) can be coated onto the supporting substrate (110) via any coating techniques, followed by drying techniques. Methods of application may include, but are not limited to, curtain coating, cascade coating, fountain coating, slide coating, slot coating, blade coating, rod coating, air-knife coating, size-press (including puddle and metered size press), or hopper coating.

Method for Producing Printed Images

In some examples, a method for forming printed images on the printable recording material described above include: obtaining a printable recording material containing an opaque supporting substrate; a resin-rich barrier layer; an ink vehicle-receiving layer having a first structure with inorganic particles and, at least, a binder and a second structure with nano-porous particles and, at least, a binder; and an ink colorant-receiving layer containing inorganic particles; providing a ink composition and applying said ink composition onto said recording material, to form a printed image.

The method for forming printed images can be done by means of digital printing technology. In some examples, the ink composition is applied by projecting a stream of droplets of ink composition onto the printable recording material, via inkjet printing technique. The ink composition may be established on the printable recording medium via any suitable inkjet printing technique. Non-limitative examples of such inkjet printing technique include thermal, acoustic, continuous and piezoelectric inkjet printing. In some examples, the ink compositions used herein are inkjet compositions; it is meant thus that said ink compositions are well adapted to be used in an inkjet device and/or in an inkjet printing process.

By inkjet printing technique, it is meant herein that the ink is applied using inkjet printing devices. Within inkjet printing devices, liquid ink drops are applied in a controlled fashion to a print medium by ejecting ink droplets from a plurality of nozzles, or orifices, in a printhead of an inkjet printing device or inkjet printer. In some examples, ink compositions may be dispensed from any piezoelectric or drop-on-demand inkjet printing devices. Such inkjet printing devices can be available from Hewlett-Packard Inc. (Palo Alto, Calif., USA) by way of illustration and not limitation. In drop-on-demand systems, a droplet of ink is ejected from an orifice directly to a position on the surface of a print medium by pressure created by, for example, a piezoelectric device, an acoustic device, or a thermal process controlled in accordance digital data signals. An ink droplet is not generated and ejected through the orifices of the printhead unless it is needed. The volume of the ejected ink drop is controlled mainly with a printhead. The printed or jetted ink may be dried after jetting the ink composition in a predetermined pattern onto a surface of a print medium. When present, the drying stage may be conducted, by way of illustration and not limitation, by hot air, electrical heater or light irradiation (e.g., IR lamps), or a combination of such drying methods. In order to achieve best performance it is advisable to dry the ink at a maximum temperature allowable by the print medium that enables good image quality without print medium deformation. In some examples, a temperature during drying is about 40° C. to about 150° C.

In some examples, the ink composition referred herein encompasses one or more colorants that impart the desired color to the printed message. As used herein, "colorant" includes dyes, pigments and/or other particulates that may be suspended or dissolved in an ink vehicle. In some other examples, the ink composition includes pigments as colorants. Pigments that can be used include self-dispersed pigments and non self-dispersed pigments. Pigments can be organic or inorganic particles as well known in the art. Such pigments are commercially available from vendors such as Cabot Corporation, Columbian Chemicals Company, Evonik, Mitsubishi, and E.I. DuPont de Nemours and Company and can be colored pigments, such as, for examples, cyan, magenta, yellow, blue, orange, red, green, pink or black pigments.

In some examples, the ink composition is a metalized ink composition and encompasses dispersed metal oxide particles. The "metal oxide particles" are particles that have particle size in the range such that they are substantially transparent to the naked eye. Said metal oxide particles have an average particle size in the range of about 3 to about 300 nm, or in the range of about 10 to about 100 nm. In some examples, the metal oxide particles have an average particle size in the range of about 10 to about 50 nm. Metal oxide particles include metal oxide pigments selected from the group consisting of titanium dioxide ($TiO_2$), in rutile or anatase crystalline form, zinc oxide (ZnO), indium oxide ($In_2O_3$), manganese oxide ($Mn_3O_4$) and iron oxide ($Fe_3O_4$). In some other examples, the metal oxide particles are iron oxide ($Fe_3O_4$) or manganese oxide ($Mn_3O_4$) particles. In yet some other examples, the ink composition can contain iron oxide ($Fe_3O_4$) as metal oxide particles.

Metal oxide particles contained in the ink compositions may have a refractive index (n) that is different from the refractive index of the inorganic particles present in the ink colorant-receiving layer (140). In fact, the bigger the differences in the refractive index (n) are, the better the reflectivity of the printed article is.

In some examples, the ink composition is an inkjet ink composition that contains, at least, metal oxide particles and an aqueous carrier. In some other examples, the ink composition contains a metal oxide, a dispersant and a liquid carrier. The amount of the metal oxide particles can represent from about 0.1 to about 10 wt % of the total weight of the ink composition. Examples of suitable dispersants include, but are not limited to, water-soluble anionic species of low and high molecular weight such as phosphates and polyphosphates, phosphonates and polyphosphonates, phosphinates and polyphosphinates, carboxylates (for example, citric acid or oleic acid), polycarboxylates (for example, acrylates and methacrylates), hydrolysable alkoxysilanes with alkoxy group attached to water-soluble (hydrophilic) moieties such as water-soluble polyether oligomer chains (for example, polyether alkoxysilanes). In some examples, the dispersant is a polyether alkoxysilane dispersant.

The ink compositions described herein contains colorant or metal oxide particles that are dispersed in a liquid vehicle or liquid carrier. "Liquid vehicle" is defined to include any liquid composition that is used to carry metal oxide particles or pigments to the substrate. Such liquid vehicles may include a mixture of a variety of different agents, including without limitation, surfactants, solvents and co-solvents, buffers, biocides, viscosity modifiers, sequestering agents, stabilizing agents and water. Though not liquid per se, the liquid vehicle can also carry other solids, such as polymers, UV curable materials, plasticizers, salts, etc.

The Printed Article

The printing method that encompass obtaining a printable recording material containing an opaque supporting substrate; a resin barrier layer; an ink vehicle-receiving layer having a first structure and a second structure; and an ink colorant-receiving layer; providing an ink composition; and applying said ink composition onto said recording material, results in a printed article with enhanced image quality and enhanced absorption performances. Such as illustrated in FIG. 4, the printed article (200) encompasses thus a printable recording material containing an opaque supporting substrate (110), a resin-rich barrier layer (120), an ink vehicle-receiving layer (130) having a first structure with inorganic particles and at least a binder and a second structure with nano-porous particles and at least a binder, and an ink colorant-receiving layer (140) with inorganic particles; and a printed feature (250) applied on top of said printable recording material.

In some examples, when the ink composition encompasses metal oxide particles with an average particle size in the range of about 3 to about 300 nm, said method results in prints with strong "metallic" appearance and high print quality/sharp details resolution. The jetting of the ink composition, that contains metal oxide particles, result in printed articles (200) with metallic color appearance and metallic luster. The resulting printed article can have a uniform coating with strong sparkling and metallic reflective appearance. By "metallic luster", it is meant herein that the printed article has an opaque or a semi-opaque appearance and reflects the light as a metal reflects it. The printed article interacts with the light and has a shiny metal appearance. The printed article has, thus, specific optical properties: it exhibits a sort of glow from reflected light and has the tendency to reflect at specular angle when exposed to directional light source. In some examples, the printed article has a gold appearance. By "gold-like appearance", it is meant herein that the printed article has a visual appearance of gold-plated surface and has the color of metallic gold (Au). However, the printed article does not contain any gold or other elemental metal particles. The printed article exhibits thus gloss and sheen as a gold object does.

In some examples, for optimum metallic appearance, the printed article (200) encompasses a printed feature (250) that can be considered as a metal oxide coating layer. Said printed feature can contain metal oxide particles that are presents in the metalized ink composition. In some examples, the printed feature (250) is a metal oxide coating layer.

Said printed feature can be a planarized optically reflective layer that encompasses metal oxide particulates, with a thickness that is in the range of about 1 to about 600 nm, or, between about 3 to about 300 nm. The metal oxide coating layer can have a density in the range about 3 to about 80 $\mu g/cm^2$ or a density in the range of about 10 to about 40 $\mu g/cm^2$. Said metal oxide layer can be optically transparent or semi-transparent.

The printed article can be useful for forming printed images that have, for examples, decorative applications, such as greeting cards, scrapbooks, brochures, book covers, signboards, business cards, certificates and other like applications. In some other examples, such printed article can be used as printed media used in printing techniques.

The preceding description has been presented only to illustrate and describe some embodiments of the present invention. However, it is to be understood that the following are only illustrative of the application of the principles of the present print medium and methods.

EXAMPLES

Ingredients

Rovene®4040 is polymer binder available from Mallard Creek Polymers Inc.

Ansilex®93 is calcined clay available from BASF.

Opercarb®A40 is precipitated calcium carbonate (PCC) available from Specify Minerals Inc.

Hydrocarb®H60 is $CaCO_3$ slurry available from Omya Inc.

Organosilane A301 is methylethoxylate available from China Onichem Specialties Co.

Mowiol® 4088 is polyvinyl alcohol (PVA) binder available from Kurraray.

Hydrocarb®H90 is grounded calcium carbonate (GCC) available from Omya Inc.

BYK24® is a defoamer available from BYK Inc.

Plurnoic®L61 is a surfactant available from BASF Inc.

Dynwet®800 is a surfactant available from BYK Inc.

Glycerol is available from Aldrich Inc.

Silwet®L7600 is polydimethylsiloxane methylethoxylate available from Momentive Inc.

Aerosil®300 is fumed silica supplied by Evonik Degussa Corporation.

Zonyl®FSN 100 is a surfactant available from DuPont.

Disperal® HP 14 is alumina nano-particles (n=1.74) available from Sasol Inc.

Aerosil®400 is silica nano-particles (n=1.54) available from Evonik Industries.

Magnesium oxide powder (n=1.73) is available from Aldrich Inc.

Silquest®Al230 is a dispersant available from Momentive Performance Materials.

LEG-1 is a branched ethylene glycol available from Liponics Technologies.

Proxel®GXL is a biocide available from Arch Chemicals.

Surfynol®465 is a surfactant from Air Products and Chemicals, Inc.

Dantocol® DHE is a crosslinking agent available from Lonza.

Trizma® Base is a solvent available from Sigma-Aldrich.

Example 1

Printable Recording Media

Recording media according to the present disclosure and comparative media are prepared. Media A(i) and A(ii) are recording media as described in the present disclosure. Media A(iii), B(iv) and C(v) are comparative media. Each printable recording media includes a supporting substrate (110), a resin-rich barrier layer (120), a porous ink vehicle-receiving layer (130) and an ink colorant-receiving layer (140).

The supporting substrate (110) is made in a pilot paper machine with a pulp containing about 70 wt % of cellulose fibers, about 22 wt % of inorganic fillers and about 8 wt % of processing additives (including PH and retention control agent; alkyl ketene dimer (AKD) as internal sizing agent; cationic starch as wet strength agent; cationic polyacrylamide as retention control agent; and other functional chemicals, such as colorant (basic dyes) and di-sulfonated optical brightness agent). The cellulose fiber contains about 80 wt % of hardwood and about 20 wt % of softwood. The filler composition contains about 80% of precipitated calcium carbonate and about 20 wt % of $TiO_2$ in the pulp furnish. The basis weight of the supporting substrate is 220 gsm.

A resin-rich barrier layer (120) is prepared in view of being applied on the supporting base substrate (110) using a pilot coater equipped with a smooth Meyer rod with a coating weight of about 5 gsm/side. The resin is a polyacrylic emulsion containing about 45 wt % solids (diluted to 15 wt % when applied) and having a glass transition temperature of 50° C. The barrier layer (120) further contains surfactants (Plurnoic®L61 and Dynwet®800) and defoamer (BYK®024) in an amount representing about 2.4 wt % of the total weight of the layer. Calcium carbonate filler is also added. TABLE 1 illustrates the formulation of the resin-rich barrier layer (120). All numbers are expressed in parts by weight based on the total weight of the composition.

TABLE 1

| Resin-rich barrier layer (120) | Parts per weigh |
|---|---|
| Rovene ® 4040 | 52 |
| Hydrocarb ® H60 | 100 |
| Plurnoic ® L61 | 0.7 |
| Dynwet ® 800 | 0.8 |
| BYK ® 024 | 0.6 |

Different ink vehicle-receiving layers (130) having formulations (a), (b) and (c) are prepared in accordance with formula as illustrated in the TABLE 2 below. The ink vehicle-receiving layers (130) encompass a first structure (131) and a second structure (132). All amounts are expressed as parts by weight based on the total weight of the composition.

TABLE 2

| Ink vehicle-receiving layer (130) | | (a) | (b) comparative | (c) comparative |
|---|---|---|---|---|
| 1st Structure (131) | Ansilex ® 93 | 40 | — | — |
| | Opercarb ® A40 | 60 | 100 | — |
| | Hydrocarb ® H90 | — | — | 100 |
| | Rovene ® 4040 | 15 | 15 | 15 |
| | BYK ® 024 | 3 | 3 | 3 |
| | Plurnoic ® L61 | 4 | 4 | 4 |
| | Coat weight (gsm) | 15 | 15 | 15 |
| | Average pore size (nm) | 140 | 255 | 65 |
| 2nd structure (132) | Aerosil ® 300 | 100 | 100 | 100 |
| | Organosilane A301 | 0.75 | 0.75 | 0.75 |
| | Mowiol ® 4088 | 18 | 18 | 18 |
| | Glycerol | 0.5 | 0.5 | 0.5 |
| | Silwet ® L7600 | 1 | 1 | 1 |
| | Coat weight (gsm) | 10 | 10 | 10 |
| | Average pore size (nm) | 35 | 35 | 35 |

Different ink colorant-receiving layers (140) having formulations (i), (ii), (iii), (iv) and (v) are prepared in accordance with the formula as illustrated in TABLE 3 below. All numbers express the weight percentage based on the total weight of the solid composition.

TABLE 3

| Ink colorant-receiving layer (140) | (i) | (ii) | (iii) | (iv) | (v) |
|---|---|---|---|---|---|
| Disperal ® HP 14 (Alumina) | 89.1 | — | — | 89.1 | 79.1 |
| Aerosil ® 400 (Silica) | — | 89.1 | — | — | — |
| Magnesium oxide powder | — | — | 89.1 | — | — |
| Mowiol ® 4088 | 10.1 | 10.1 | 10.1 | 10.1 | 10.1 |
| Zonyl FSN 100 | 0.6 | 0.6 | 0.6 | 0.6 | 0.6 |
| Silwet L7605 | 0.2 | 0.2 | 0.2 | 0.2 | 0.2 |
| Average pore size (nm) | 17 nm | 24 nm | 80 nm | 17 nm | 17 nm |

The metal oxide particles, in the form of a powder (containing alumina, Magnesium or silica) are firstly dispersed under high shear under acidic condition by adding 1.5 to 2 wt % of acetic acid in the dispersion solution. The metal oxide particles have different particles sizes and refractive index, as illustrated in TABLE 4.

TABLE 4

| Metal oxide particles | Primary Particle size (nm) | Refractive index |
|---|---|---|
| Disperal ® HP 14 (Alumina) | 24 nm | 1.74 |
| Aerosil ® 400 (Silica) | 36 nm | 1.54 |
| Magnesium oxide powder | 110 nm | 1.73 |

The resin-rich barrier layer (120) having the formulation as illustrated in TABLE 1, is applied on one side of the supporting substrate (110) (having a basis weight of 220 gsm) using a pilot coater equipped with a smooth Meyer rod with a coating weight 5 gsm/side. Ink vehicle-receiving layers (130), having formulations (a), (b) and (c), as illustrated in TABLE 2, are then applied, using a pilot coater equipped with slot die device, on the image side of the media over the resin-rich barrier layer (120). The first structure (131) of the ink vehicle-receiving layer (130), is applied with a coat weight of about 15 gsm and the second structure (132) of the ink vehicle-receiving layer (130), is applied with a coat weight of about 10 gsm. The first and second structures are applied simultaneously without using drying process between each step.

The ink colorant-receiving layers (140), having the formulations (i), (ii), (iii), (iv) or (v), as illustrated in TABLE 3, are applied over the ink vehicle-receiving layer (130) with a slot die coater at a coat weight of about 0.3 gsm, in view of obtaining the recording media: A(i), A(ii), A(iii), B(iv) and C(v). The compositions of the recording media: A(i), A(ii), A(iii), B(iv) and C(v) are illustrated in the TABLE 5.

TABLE 5

| Recording MEDIA | A(i) | A(ii) | A(iii) | B(iv) | C(v) |
|---|---|---|---|---|---|
| supporting substrate (110) | 220 gsm | 220 gsm | 220 gsm | 220 gsm | 220 gsm |
| resin-rich barrier layer (120) | 5 gsm | 5 gsm | 5 gsm | 5 gsm | 5gsm |
| ink vehicle-receiving layer (130) | 25 gsm of (a) | 25 gsm of (a) | 25 gsm of (a) | 25 gsm of (b) | 25 gsm of (c) |
| Ink colorant-receiving layer (140) | 0.3 gsm of (i) | 0.3 gsm of (ii) | 0.3 gsm of (iii) | 0.3 gsm of (i) | 0.3 gsm of (i) |

Example 2

Recording Media Performances

Ink compositions are prepared based on dispersions containing $Fe_3O_4$ nanoparticles. The dispersion is produced by milling nanoparticle $Fe_3O_4$ powder (Inframat Advanced Materials, Manchester, Conn.) in a Ultra Apex Mill® UAM-015 (Kotobuki Industries Co., LTD, Kure, Japan) with a dispersant, Silquest®A1230 at a dispersant/metal oxide particles ratio equal to 0.5. The resulting dispersion contains about 8 wt % or about 4.2 wt % of $Fe_3O_4$ particles. The average particle size of $Fe_3O_4$ particles is of about 25 nm or of about 35 nm, as measured by a Nanotrack® particle size analyzer (Microtrac Corp., Montgomeryville Pa.). The dispersion is then used to produce ink compositions #1 and #2 as summarized in the TABLE 6. All numbers expressed the percentage per weight of each ingredient based on the total weight of the ink composition.

TABLE 6

| Ink Formulation | #1# | #2 # |
|---|---|---|
| $Fe_3O_4$ Dispersion (8 wt. %). Average particle size Mv = 25 nm | 24.8 | — |
| $Fe_3O_4$ Dispersion (4.2 wt. %) Average particle size Mv = 35 nm | — | 48 |
| LEG-1 | 5.00 | — |
| Dantocol ® DHE | — | 5.00 |
| 2-Pyrrolidinone | 9.00 | 9.00 |
| Trizma ® Base | 0.20 | 0.20 |
| Proxel ® GXL | 0.10 | 0.10 |
| Surfynol ® 465 | 0.20 | 0.20 |
| Water | Up to 100 % | Up to 100 % |

Ink compositions #1 and #2, as illustrated in TABLE 6, are filled into HP print cartridge #94. Such ink compositions are applied on the recording media A(i), A(ii), A(iii), B(iv) and C(v), using a HP Photosmart 8540 printer (Hewlett Packard, Palo Alto Calif.). The printed articles are produced at ink flux density in the range of about 50 to about 125 pL/300th pixels.

The resulting printed articles are evaluated for their reflectance (R), their visual appearance, the ink load (at peak R) and for the bleeding and coalescence performances. The reflectance R, in percentage (%), is the percentage of reflectance on printed square versus the reflectance percentage on un-printed media (measured by a BYK reflectance meter), higher numbers illustrate better reflectance. The ink load at peak R represents the amount of ink needed to obtain the best reflectance effect (smaller numbers illustrate better performances). The metallic appearance and printing quality, ink bleed and coalescence, are evaluated visually. The results are summarized in TABLE 7.

TABLE 7

| MEDIA | R(%) | Ink load at peak R | Ink bleed/ coalescence | metalized appearance |
|---|---|---|---|---|
| A(i) - Alumina | 16.1 | 72.8 pL/300th | Good | very good metallic look |
| A(ii) - Silica | 11.1 | 112.0 pL/300th | Good | good metallic look |
| A(iii) - Magnesium | 3.4 | 123.2 pL/300th | Good | No metallic look |
| B(iv) - Alumina | 8.3 | 67.2 pL/300th | Good | Low metallic look |
| C(v) - Alumina | 5.5 | 45.0 pL/300th | Bad | No metallic look |

Samples A(i), B(iv) and C(v) illustrate the printing performances associated with the structure of the ink vehicle-receiving layer (130). These results demonstrate that the first structure (131) and its average pore size influence the performance of the printed article. It can be seen that when the average pore size of the first structure (131) of the ink vehicle-receiving layer (130) is in the range of about 70 to 250 nm, the reflection (R) shows its maximum value (16.1%) with moderate ink loading (72.8 pL/300$^{th}$). When the average pore size of the first structure (131) of the ink vehicle-receiving layer (130) are too large (more than 250 nm), the printed article does not have a good metallic look (mainly due to greater penetration of the ink colorant). When the average pore size of the first structure (131) of the ink vehicle-receiving layer (130) is too small (less than 70 nm), the printed article does not have a metallic look and shows poor performances on ink bleed and coalescence.

The samples A(i), A(ii) and A(iii) illustrate the influences of the particles present in ink colorant-receiving layer (140). It is believed that the pore structures in samples A(i) and A(ii) block penetration of the ink colorant particles and allow thus the formation of a continuous film. Such a film structure provides thus a metallic appearance when the colorant is a metal oxide particle. In contrast, the open structure of A(iii) makes the colorant particles falling into the deeper structure of ink vehicle-receiving layer and weakens the metallic appearance. Such data demonstrates the performances are improved when the average pore size of the ink colorant-receiving layer (140) is smaller than the average pore size of the ink vehicle-receiving layer (130).

The invention claimed is:

1. A printable recording material comprising:

a. an opaque supporting substrate;

b. a resin-rich barrier layer;

c. an ink vehicle-receiving layer having i. a first structure with inorganic particles and, at least, a binder; and ii. a second structure with nano-porous particles and, at least, a binder;

d. an ink colorant-receiving layer comprising inorganic particles, wherein an average pore size of the ink colorant-receiving layer is smaller than an average pore size of the second structure in the ink vehicle-receiving layer.

2. The printable recording material of claim 1 wherein the supporting substrate comprises inorganic fillers in an amount ranging from about 8 wt % to about 40 wt % by total weight of the supporting substrate.

3. The printable recording material of claim 1 wherein the supporting substrate comprises a mixture of calcium carbonate and $TiO_2$ particles as inorganic fillers, said fillers being present in an amount representing more than about 15 wt % of the total weight of the supporting substrate.

4. The printable recording material of claim 1 wherein the resin-rich barrier layer includes from about 30 to about 80 wt % of polymer resin binder by total weight of the barrier layer.

5. The printable recording material of claim 1 wherein the resin-rich barrier layer contains resins that are formed by hydrophobic polymerization of monomers of $C_3$-$C_{12}$ alkyl acrylate and methacrylate.

6. The printable recording material of claim 1 wherein the ink vehicle-receiving layer comprises a first structure with an average pore size in the range of about 70 nm to about 250 nm.

7. The printable recording material of claim 1 wherein the ink vehicle-receiving layer comprises a first structure with calcium carbonates or clays as inorganic particles.

8. The printable recording material of claim 1 wherein the ink vehicle-receiving layer comprises a second structure with fumed silica, fumed alumina, boehmite or pseudo-boehmite as nano-porous inorganic particles.

9. The printable recording material of claim 1 wherein the ink vehicle-receiving layer comprises a second structure with an average pore size that is smaller than the average pore size of first structure and that is in the range of about 10 nm to about 100 nm.

10. The printable recording material of claim 1 wherein the ink colorant-receiving layer contains inorganic particles that can be selected from the group consisting of aluminum oxide ($Al_2O_3$), silicon dioxide ($SiO_2$), nanocrystalline boehmite alumina (AlO(OH)) and aluminum phosphate ($AlPO_4$).

11. A method for making a printable recording material comprising:

a. providing an opaque supporting substrate;

b. applying a resin-rich barrier layer, an ink vehicle-receiving layer containing a first structure with inorganic particles and at least a binder and a second structure with nano-porous particles and at least a binder, and applying an ink colorant-receiving layer comprising inorganic particles on top of said layers;

c. and drying and calendaring the layers, wherein an average pore size of the ink colorant-receiving layer is smaller than an average pore size of the second structure in the ink vehicle-receiving layer.

12. A method for producing printed images comprising:

a. obtaining a printable recording material containing an opaque supporting substrate, a resin-rich barrier layer, an ink vehicle-receiving layer having a first structure with inorganic particles and at least a binder and a second structure with nano-porous particles and at least a binder, and an ink colorant-receiving layer comprising inorganic particles, wherein an average pore size of the ink colorant-receiving layer is smaller than an average pore size of the second structure in the ink vehicle-receiving layer;

b. providing an ink composition;

c. applying the ink composition onto said recording material to form a printed image.

13. The method for producing printed images of claim 12 wherein the ink composition is a metalized ink composition that encompasses dispersed metal oxide particles.

14. A printed article obtained according to the method of claim 12 comprising:

a. a printable recording material containing an opaque supporting substrate, a resin-rich barrier layer, an ink vehicle-receiving layer having a first structure with porous inorganic particles and at least a binder and a second structure with nano-porous particles and at least a binder, and an ink colorant-receiving layer comprising inorganic particles;

b. a printed feature applied on top of said printable recording material.

* * * * *